US008701243B2

(12) United States Patent
Ward et al.

(10) Patent No.: US 8,701,243 B2
(45) **Date of Patent: *Apr. 22, 2014**

(54) WASTE RECEPTACLE

(75) Inventors: Bill Ward, Ravanel, SC (US); Jordan Diatlo, New York, NY (US); Kate Vallon, New York, NY (US); Gareth Brown, Jersey City, NJ (US); Nikki Kaufman, New York, NY (US)

(73) Assignee: Quirky, Inc., New York, NY (US)

( * ) Notice: Subject to any disclaimer, the term of this patent is extended or adjusted under 35 U.S.C. 154(b) by 82 days.

This patent is subject to a terminal disclaimer.

(21) Appl. No.: 13/226,745

(22) Filed: Sep. 7, 2011

(65) Prior Publication Data

US 2012/0260453 A1 Oct. 18, 2012

Related U.S. Application Data

(60) Provisional application No. 61/476,663, filed on Apr. 18, 2011.

(51) Int. Cl.
*A47L 13/52* (2006.01)

(52) U.S. Cl.
USPC ..... 15/257.1; 15/142; 15/257.2

(58) Field of Classification Search
USPC ..... 15/257.1, 257.2, 257.3, 257.6, 257.8, 15/257.9, 245, 142
See application file for complete search history.

(56) References Cited

U.S. PATENT DOCUMENTS

| | | | | |
|---|---|---|---|---|
| 445,278 | A | 1/1891 | Chubb | |
| 735,565 | A | 8/1903 | McCarthy | |
| 853,486 | A | 5/1907 | Tungate et al. | |
| 1,225,540 | A | 5/1917 | Wells | |
| 1,315,310 | A | 9/1919 | Kelley | |
| 1,683,517 | A | 9/1928 | Bentley | |
| 3,408,681 | A | 11/1968 | Isakson | |
| 5,457,844 | A * | 10/1995 | Hanna et al. | 15/257.3 |
| 5,826,297 | A * | 10/1998 | Footer et al. | 15/257.2 |
| 8,555,459 | B2 * | 10/2013 | Ward et al. | 15/257.1 |

OTHER PUBLICATIONS

Matthias Lange, Foot-Dustpan, 2007, Product Detail [online], [Retrieved from the Internet May 13, 2011]. <URL: http://kisd.de/~matti/pics/dustpan/work.htm>, 2 pages.

Oxo, Step & Sweep Dust Pan [online], [Retrieved from the Internet May 13, 2011]. <URL: http://www.oxo.com/p-262-step-sweep-dust-pan.aspx>, 1 page.

(Continued)

*Primary Examiner* — Monica Carter
*Assistant Examiner* — Stephanie Berry
(74) *Attorney, Agent, or Firm* — Cooley LLP

(57) ABSTRACT

An apparatus and methods for collecting swept waste material are described herein. The apparatus includes a dustpan having a base and a wall, a handle, and a plurality of protrusions. The base is configured to be placed in contact with a surface to be cleaned and includes a front lip over which debris can be swept. The wall extends upwardly from at least a portion of the base other than the front lip and is configured to contain debris in the dustpan. The handle is coupled to a top edge of the wall opposite the front lip and extends away from the wall and downwardly from the top edge so that an end of the handle is disposed approximately even with the base. The plurality of protrusions extend inwardly from the wall and are configured to remove debris from bristles of a broom when the broom is swept across the plurality of protrusions.

36 Claims, 13 Drawing Sheets

(56) References Cited

OTHER PUBLICATIONS

Butler Home Products, LLC, Step-On-It Dustpan [online], [Retrieved from the Internet May 13, 2011]. <URL:http:www.cleanerhomeliving.com/index.cfm/page/STEP-ON-IT-DUSTPAN/pk/category . . . >, 1 page.

Broom Groomer,Quirky Product Development, printed from Quirky.com, [retrieved from Internet Jan. 28, 2013] 28 pages.

Broom Groomer,Quirky Product Development, printed from Quirky.com, [retrieved from Internet Jan. 28, 2013] 46 pages.

Foot/Hand Pan,Quirky Product Development, printed from Quirky.com, [retrieved from Internet Jan. 28, 2013] 34 pages.

Flipping Broom Groomer,Quirky Product Development, printed from Quirky.com, [retrieved from Internet Jan. 28, 2013] 39 pages.

Cross-Bristled Broom Groomer,Quirky Product Development, printed from Quirky.com, [retrieved from Internet Jan. 28, 2013] 37 pages.

Dust Trap Broom Groomer,Quirky Product Development, printed from Quirky.com, [retrieved from Internet Jan. 28, 2013] 44 pages.

"Broom Groomer," Quirky.com/products/36, Mar. 22, 2010 (9 pages).

www.quirky.com/projects/261, Internet Archive Wayback Machine, dated Mar. 25, 2010, 9 pages.

* cited by examiner

WASTE RECEPTACLE

CROSS-REFERENCE TO RELATED APPLICATION

This application claims priority to and the benefit of U.S. Provisional Patent Application Ser. No. 61/476,663, filed Apr. 18, 2011, entitled "Waste Receptacle," the disclosure of which is hereby incorporated. by reference in its entirety.

BACKGROUND

The present invention generally relates to an apparatus and methods for collecting swept waste material, and particularly to a waste receptacle with a foot pedal and a set of protrusions for removing debris from the bristles of a broom.

Waste receptacles or "dustpans" can be used to collect debris swept into the body of the pan by a broom and are Tpically comprised of a pan and/or base, a set of walls, and a handle that typically extends laterally from a rear wall of the pan. A user normally holds the dustpan in one hand by the handle while using a broom in the other hand to sweep debris into the pan. This process can become cumbersome and inefficient as a user may try to stabilize the broom using a shoulder or other body part. In some instances, two people may perform the operation, with one person holding the handle of the dustpan and the other person using the broom to sweep debris into the dustpan. In other instances, a user can choose to use a small handheld broom, requiring the user to bend down and/or kneel to sweep debris into the dustpan. Furthermore, swept debris can become entrained in the bristles of the broom during this process and fall out of the bristles outside of the dustpan or otherwise spread to undesired locations.

Thus, a need exists for a waste receptacle or dustpan that can be easily held in place, with for example a foot, and that effectively removes debris from the bristles of a broom without spreading debris to areas outside of the dustpan.

SUMMARY

An apparatus and methods for collecting swept waste material are described herein. In some embodiments, an apparatus includes a dustpan having a base and a wall, a handle, and a plurality of protrusions. The base is configured to be placed in contact with a surface to be cleaned and includes a front lip over which debris can be swept. The wall extends upwardly from at least a portion of the base other than the front lip and is configured to contain debris in the dustpan. The handle is coupled to a top edge of the wall opposite the front lip and extends away from the wall and downwardly from the top edge so that an end of the handle is disposed approximately even with the base. The plurality of protrusions extend inwardly from the wall and are configured to remove debris from bristles of a broom when the broom is swept across the plurality of protrusions.

DETAILED DESCRIPTION

Figure 1:
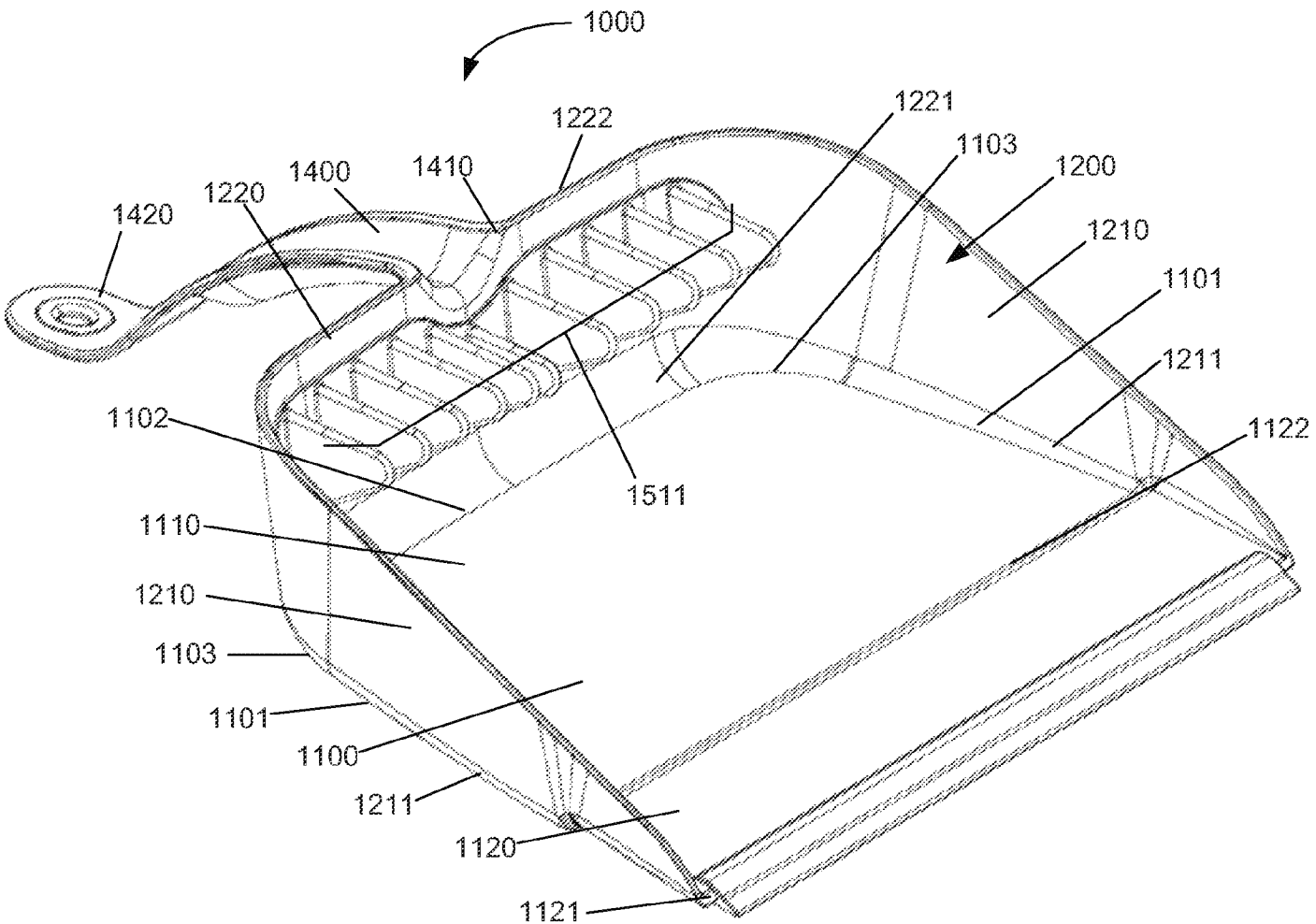
FIG. 1 is a perspective view of a dustpan according to an embodiment.

An apparatus and methods for collecting swept waste material are described herein. In some embodiments, an apparatus includes a dustpan having a base and a wall, a handle, and a plurality of protrusions. The base is configured to be placed in contact with a. surface to be cleaned and includes a from lip over which debris can be swept. The wall extends upwardly from at least a portion of the base other than the front lip and is configured to contain debris in the dustpan. The handle is coupled to a top edge of the wall opposite the front lip and extends away from the wall and downwardly from the top edge so that an end of the handle is disposed approximately even with the base. The handle can have an amuate shape between a first end coupled to the top edge of the wall and a second end approximately even with the base. The handle can, for example, further include a foot pedal extending rearwardly from the second end configured to be engagable by the foot of a user to anchor the second end of the handle to a surface to be cleaned. The plurality of protrusions extend inwardly from the wall and are confitzured to remove debris from bristles of a broom when the broom is swept across the plurality of protrusions.

In some embodiments, an apparatus for collecting swept waste material includes a dustpan having a base and a wall, a handle, and a plurality of protrusions. The base is configured to be placed in contact with a surface to be cleaned and includes a front lip over which debris can be swept. The wall extends upwardly from at least a portion of the base other than the front lip. The handle is coupled to the dustpan and extends away from the dustpan so that an end of the handle is disposed approximately even with the base. The plurality of protrusions extend inwardly from the wall and have a triangular cross-section. The protrusions can be, for example, flexible or rigid, and can be made from a rubber or plastic material. The protrusions can also be, for example, approximately equally spaced from each other or non-uniformly spaced from each other. The protrusions are configured to remove debris from a set of bristles of a broom by separating the bristles a sufficient amount such that debris is dislodged between adjacent bristles.

In some embodiments, an apparatus for collecting swept waste material includes a dustpan having a base and a wall, a handle, and a tooth assembly having a set of protrusions. The base is configured to be placed in contact with a surface to be cleaned and includes a front lip over which debris can be swept. The wall includes at least one aperture and extends upwardly from at least a portion of the base other than the front lip and is configured to contain debris in the dustpan. The handle is coupled to the dustpan and extends away from the dustpan so that an end of the handle is disposed approximately even with the base. The tooth assembly includes a plurality of flexible protrusions on a first surface and a mushroom-shaped projection on a second surface opposite the first surface. The mushroom-shaped projection is configured to pass through the aperture in the wall of the dustpan and secure the tooth assembly to the wall so that the plurality of flexible protrusions extend inwardly from the wall and are configured to remove debris from a set of bristles of a broom by separating the bristles a sufficient amount such that debris is dislodged between adjacent bristles. The tooth assembly can be, for example, unitarily formed from a flexible or rigid material such as plastic or rubber.

It is noted that, as used in this written description and the appended claims, the singular forms "a," "an" and "the" include plural referents unless the context clearly dictates otherwise. Thus, for example, the term "a wall" is intended to mean a single wall or a combination of walls. Furthermore, the words "proximal" and "distal" refer to a direction closer to and away from, respectively, an user who would hold the waste receptacle at a handle (i.e., proximal end) with a front lip (i.e., distal end) of the dustpan receiving debris.

As used herein, a "set" can refer to multiple features or a singular feature with multiple parts. For example, when referring to set of walls, the set of walls can be considered as one wall with distinct portions, or the set of walls can be considered as multiple walls.

Figure 2:
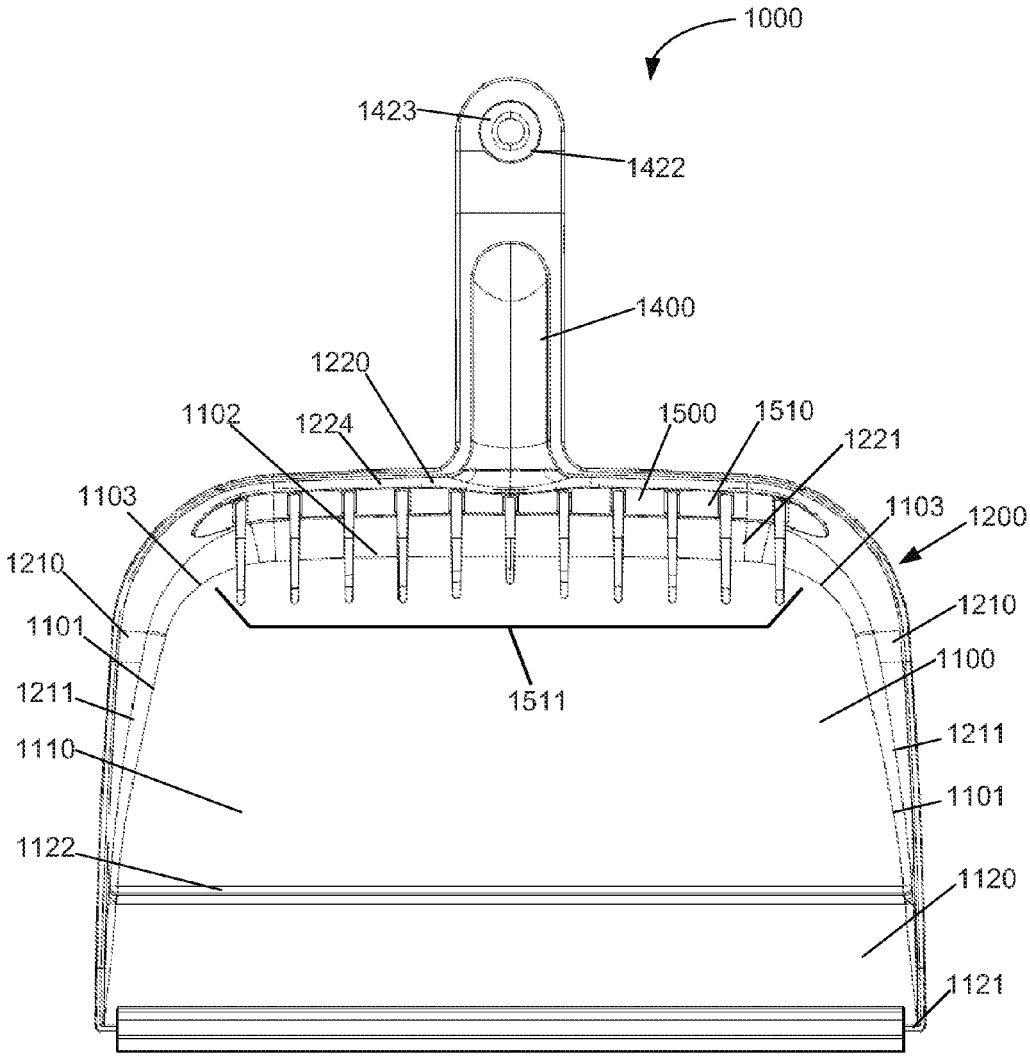
FIG. 2 is a top view of the dustpan of FIG. 1.

FIGS. 1-4 illustrate a waste receptacle 1000 according to an embodiment. The waste receptacle 1000 (also referred to herein as a "dustpan") can be used to collect debris that is swept into the waste receptacle 1000 by a broom or the like. The waste receptacle 1000 includes a base 1100, a set of walls 1200, a handle 1400, and a plurality of protrusions 1511. The base 1100 includes a first portion 1110 and a second. portion 1120 and is configured to be placed in contact with a surface to be cleaned. As best shown in FIG. 2, the base 1100 includes a substantially straight distal edge, referred to herein as a front lip 1121 and a substantially straight back edge 1102. A pair of side edges 1101 extend inwardly from the wider front lip 1121 to form rounded corners 1103 with the narrower back edge 1102. While described, and shown in FIGS. 1 and 2 as having a specific shape, the base 1100 can be any suitable shape. For example, in some embodiments the base 1100 can be semi circular, square, rectangular, or any suitable asymmetric shape.

The first portion 1110 of the base 1100 is configured to contain debris after it has been swept into the dustpan 1000. The second portion 1120 extends from the first portion 1110 and forms a discontinuity 1122 between the first portion 1110 and the second portion 1120. The discontinuity can be a rise in the base 1100 and/or a rounded step in the base 1100. The discontinuity 1122 is configured to contain the debris that is swept into the dustpan 1000 in the first portion 1110. For example, if the dustpan 1000 is placed at an angle such that debris slides from the first portion 1110 toward the front lip 1121, the discontinuity 1122 acts to confine the debris within the first portion 1110, thus reducing the risk of spilling the debris. Although described as being a rounded step, the discontinuity 1122 can be any suitable shape, size, or configuration that aids in confining the debris to the first portion 1110. For example, in some embodiments the discontinuity 1122 can be a ridge of any suitable cross-section.

The set of walls 1200 includes a pair of side walls 1210 and a back wall 1220. The side walls 1210 extend upwardly from the side edges 1101 and the back wall 1220 extends upwardly from the back edge 1102 of the base 1100. Similarly stated, the set of walls 1200 extend upwardly on all the edges of the base 1100 except for the front lip 1121. More specifically, a bottom portion 1211 of the side walls 1210 form a rounded contour with the side edges 1101 of the base 1100 as the side walls 1210 extend upwardly from the base 1100. Similarly, a bottom portion 1221 of the back wall 1220 forms a rounded contour with the back edge 1102 of the base 1100 as the back wall 1220 extends upwardly from the base 1100. Although shown in FIG. 1 as substantially non-uniform, the bottom portion 1211 of the side walls 1210 and the bottom portion 1221 of the back wall 1220 can form a rounded contour with the base 1100 of constant radius. Furthermore, the pair of side walls 1210 and the back wall 1220 can be unitarily formed. with each other and/or unitarily formed with the base 1100.

Figure 3:
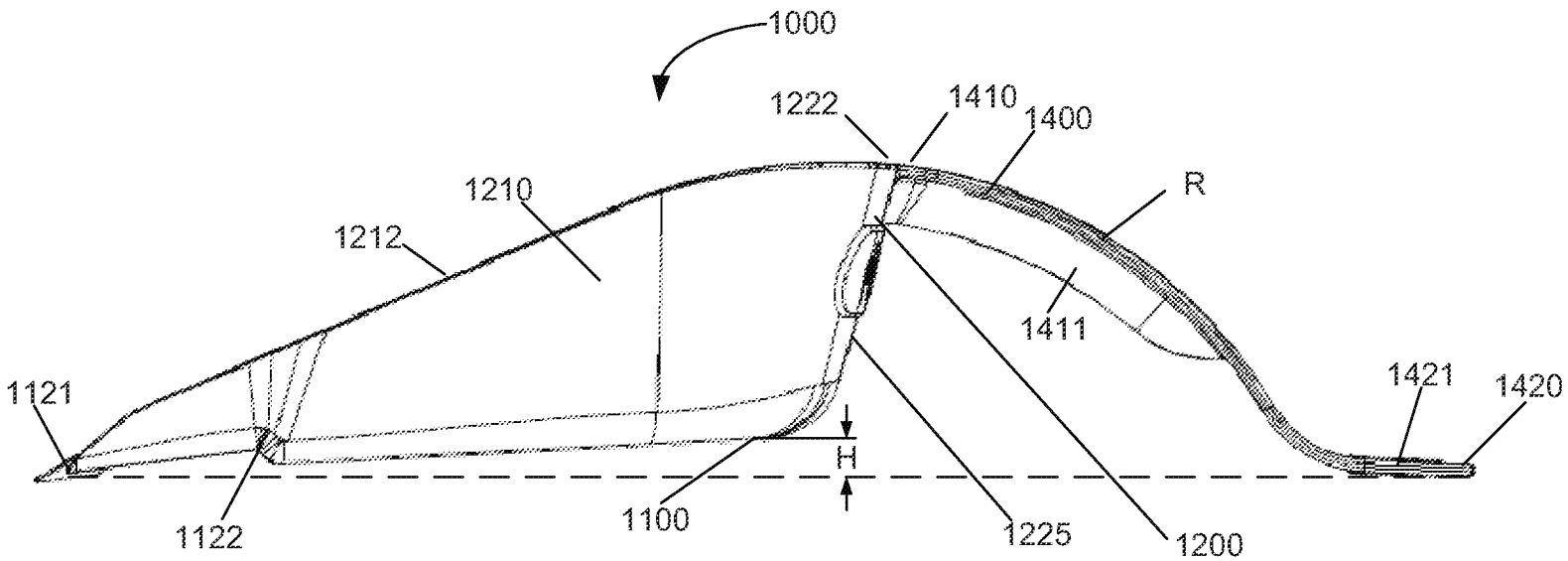
FIG. 3 is a side view of the dustpan of FIG. 1.

As best shown in FIG. 3, the side walls 1210 include a tapered edge 1212 that decreases in height as the side walls 1210 extend from the back wall 1220 towards the front lip 1121. The arrangement of the tapered edges 1212 provides a taller wall height at the area of debris storage (i.e., the first portion 1110, shown in FIG. 1), while saving on material usage by decreasing the wall height at areas where debris storage is less likely (i.e., the second portion 1120, shown in FIG. 1).

The handle 1400 includes a first end 1410 and a second end 1420. The first end 1410 of the handle 1400 extends from a top edge 1222 of the back wall 1220 in a direction opposite the front lip 1121. Similarly stated, the first end 1410 of the handle 1400 extends from the top edge 1222 of the back wall 1220 in the direction of a user. As shown, the handle 1400 extends from the first end 1410, at a substantially higher point of the handle 1400, to the second end 1420, at a substantially lower point of the handle 1400, in an arcuate path with a radius of curvature R. The radius of curvature R can be any suitable radius such that an arcuate path exists between the front end 1410 of the handle 1400 and the second end 1420 of the handle 1400. In some embodiments, the radius of curvature R can be uniform, i.e., a constant radius forming a smooth arc between the first end 1410 and the second end 1420.

The second end 1420 of the handle 1400 can include a foot pedal 1421. As described above, the second end 1420 is located at a lower point of the handle 1400. More specifically, the foot pedal 1421 is a substantially flat portion of the handle 1400 with the bottom surface configured to be placed in contact with the surface to be cleaned. Furthermore, the foot pedal 1421 is at a substantially similar vertical position as the front lip 1121. Said another way, the front lip 1121 and the foot pedal 1421 are both in contact with the surface to be cleaned when in use. As shown, the arrangement of the handle 1400, and more specifically the second end 1420, creates an offset distance between the proximal end of the base 1100 and the surface to be cleaned. Similarly stated, the second end 1420 of the handle 1400 extends below the surface of the proximal end of the base 1100 such that a height H exists between the proximal end of the base 1100 and the surface to be cleaned. In alternative embodiments, the front lip 1121, the proximal end of the base 1100, and the second end of the handle 1420 can all be substantially in contact with the surface to be cleaned.

As described above, the foot pedal 1421 is a substantially flat portion of the second end 1420 of the handle 1400. The top surface of the foot pedal 1421 is configured to receive the user's foot, thus anchoring the dustpan 1000 to the surface to be cleaned. The size of the foot pedal 1421 is such that a portion of the user's foot can contact a curved portion of the handle 1400. The handle 1400 is configured such that when the user's foot contacts the curved portion of the handle 1400 the downward force applied by the user's foot is transferred through the handle 1400 towards the body of the dustpan 1000 (i.e., the base 1100 and walls 1200). In this manner, the handle 1400 acts as a lever such that the downward force of the user's foot results in the first end 1410 of the handle 1400 applying a corresponding downward force to the body of the dustpan 1000. The resulting force at the first end 1410 of the handle 1400 causes the base 1100 to move downward reducing the height H that exists between the base 1100 and the surface to be cleaned until the proximal end of the base 1100 comes in contact with the surface to be cleaned.

The foot pedal 1421 can include an aperture 1422 (FIG. 2). The aperture is configured to receive an insert 1423. More specifically, the aperture 1422 and the insert 1423 are configured to create a friction fit, such that the insert 1423 is securely disposed within the aperture 1422. The insert 1423 is formed of a flexible material, such as for example, rubber. This enables the insert 1423 to conform to the size and shape of the aperture 1422. Furthermore, the insert 1423 increases the friction between the user's foot and the foot pedal 1421, thereby reducing the potential for the user's foot to slip off the foot pedal 1421 when in use. The insert 1423 includes a hole that is used to hang the dustpan 1000 from a hook or other suitable device to store the dustpan 1000 when not in use.

The handle 1400 can also include a grip portion 1411 disposed between the first end 1410 and the second end 1420. As shown, the grip portion 1411 has an arcuate cross-section 1412. The arcuate cross-section 1412 of the grip portion 1411 provides an ergonomic configuration for the user to grip the handle 1400 of the dustpan 1000. The grip portion 1411 extends below the handle 1400 such that a curved surface of the arcuate cross-section 1412 matches the natural curve of the user's hand while gripping the handle 1400. While shown as substantially smooth, the grip portion 1411 can be textured to create more friction with the user's hand, in some embodiments, the arcuate cross-section 1412 of the grip portion 1411 can include a set of indentations configured to match the placement of a user's individual fingers, whereas each indentation would create a channel for an individual finger. Although described, as being arcuate, the cross-section 1412 could be any suitable shape. For example, in some embodiments the cross-section can be substantially rectangular with or without rounded corners, elliptical, or round.

Figure 4:
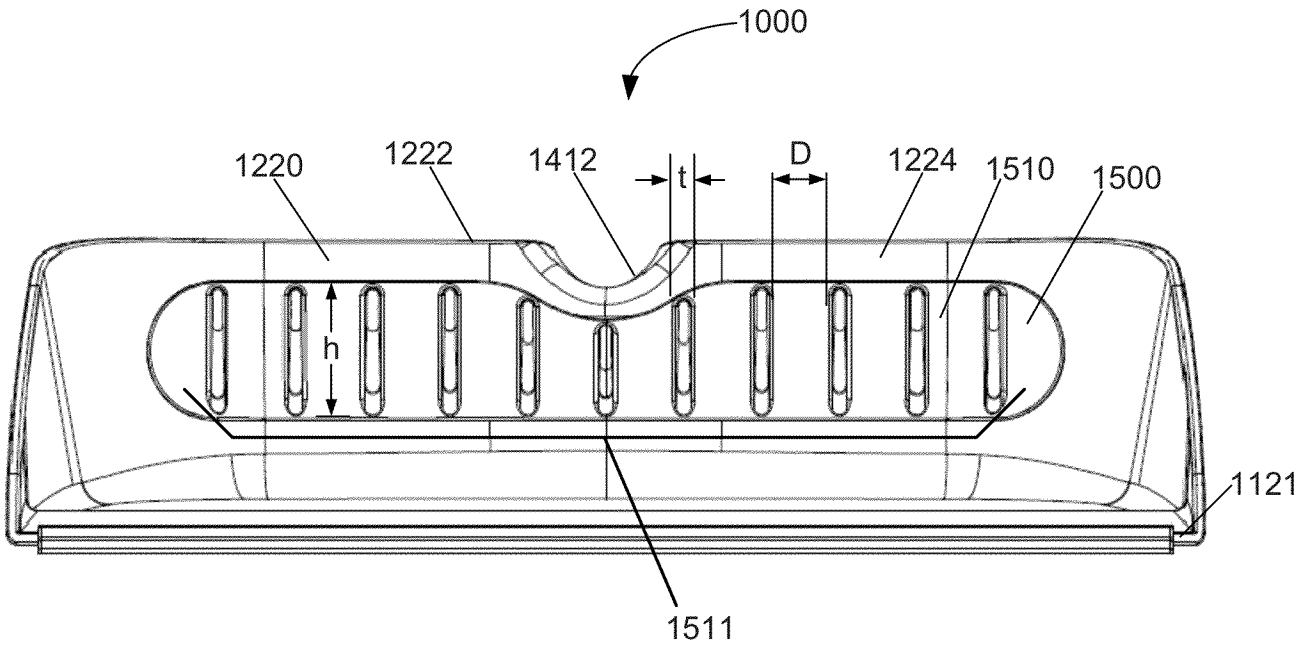
FIG. 4 is a front view of the dustpan of FIG. 1.

As described above, the dustpan 1000 includes a plurality of protrusions 1511 that extend from the back wall 1220 toward the front lip 1121. The plurality of protrusions 1511 are configured to remove debris from a set of bristles of the broom by separating the bristles a sufficient amount such that debris is dislodged between adjacent bristles. The plurality of protrusions 1511 are configured such that a distance D exists between the individual protrusions 1511. While shown as being substantially similar, the distance D between the protrusions 1511 can vary. For example, in some embodiments the spacing between adjacent protrusions in an inner portion can be less than the spacing between adjacent protrusions in an outer portion. As shown in FIG. 4, each protrusion 1511 has a thickness t which is substantially less than the distance D between adjacent protrusions 1511. For example, the distance D between adjacent protrusions 1511 can be greater than twice the thickness t of each of the protrusions 1511. Furthermore, each of the protrusions 1511 has a height h at the first surface 1510 (FIG. 6C) such that the height h of each of the protrusions 1511 is greater than the thickness t.

Figure 5:
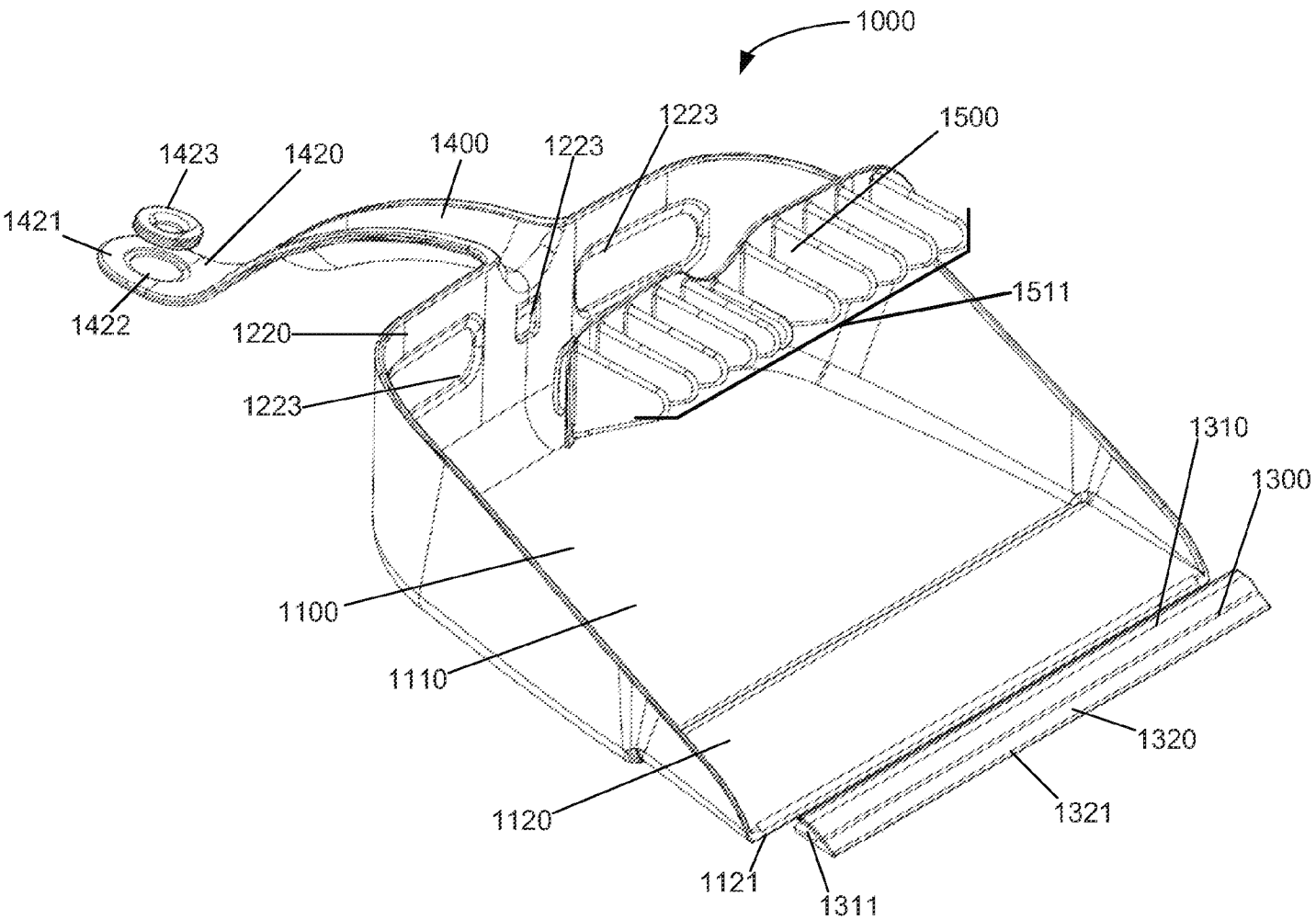
FIG. 5 is an exploded perspective view of the dustpan of FIG. 1.

Referring now to FIG. 5, the dustpan 1000 can include a skirt 1300 configured to be coupleable to the front lip 1121 of the base 1000. The skirt includes a first portion 1310 and a second portion 1320. The first portion 1310 includes a mating contour 1311 configured to match the contour of the front lip 1121. The skirt 1300 can be coupled to the front lip 1121 using any suitable mechanism, for example, using adhesives or mechanical fasteners. The second portion 1320 of the skirt 1300 extends from the first portion 1310 creating a transition 1321 configured to reduce the particles of debris that can fit between the front lip 1121 and the surface being cleaned.

The plurality of protrusions 1511 can be incorporated into a tooth assembly 1500 such that the plurality of protrusions 1511 are unitarily formed with the tooth assembly 1500. In some embodiments, the plurality of protrusions 1511 can be mechanically fastened to the tooth assembly 1500. The tooth assembly 1500 can be coupled to the back wall 1220 of the dustpan 1000 using adhesives or mechanical fasteners. For example, as shown, the tooth assembly 1500 can be disposed, at least partially, within a set of apertures 1223 defined by the back wall 1220. While described as a set of apertures 1223, the set could be a singular aperture 1223. Furthermore, the aperture or apertures 1223 can define any suitable shape, for example, circular, square, or rectangular. The set of apertures 1223 can be configured to receive a portion of the tooth assembly 1500, as described below.

Figure 6A:
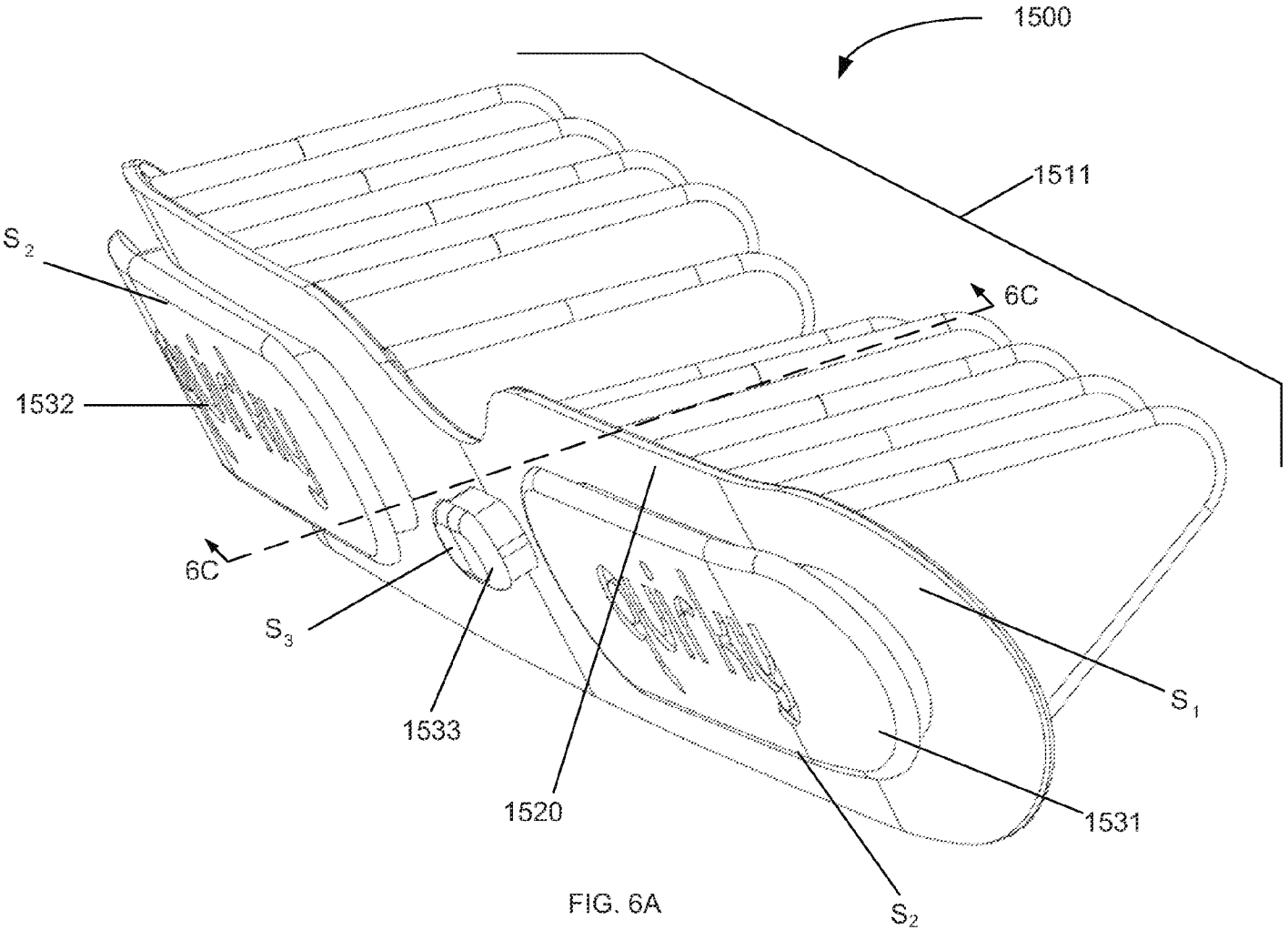
FIG. 6A is a rear perspective view of a tooth assembly according to an embodiment.
Figure 6B:
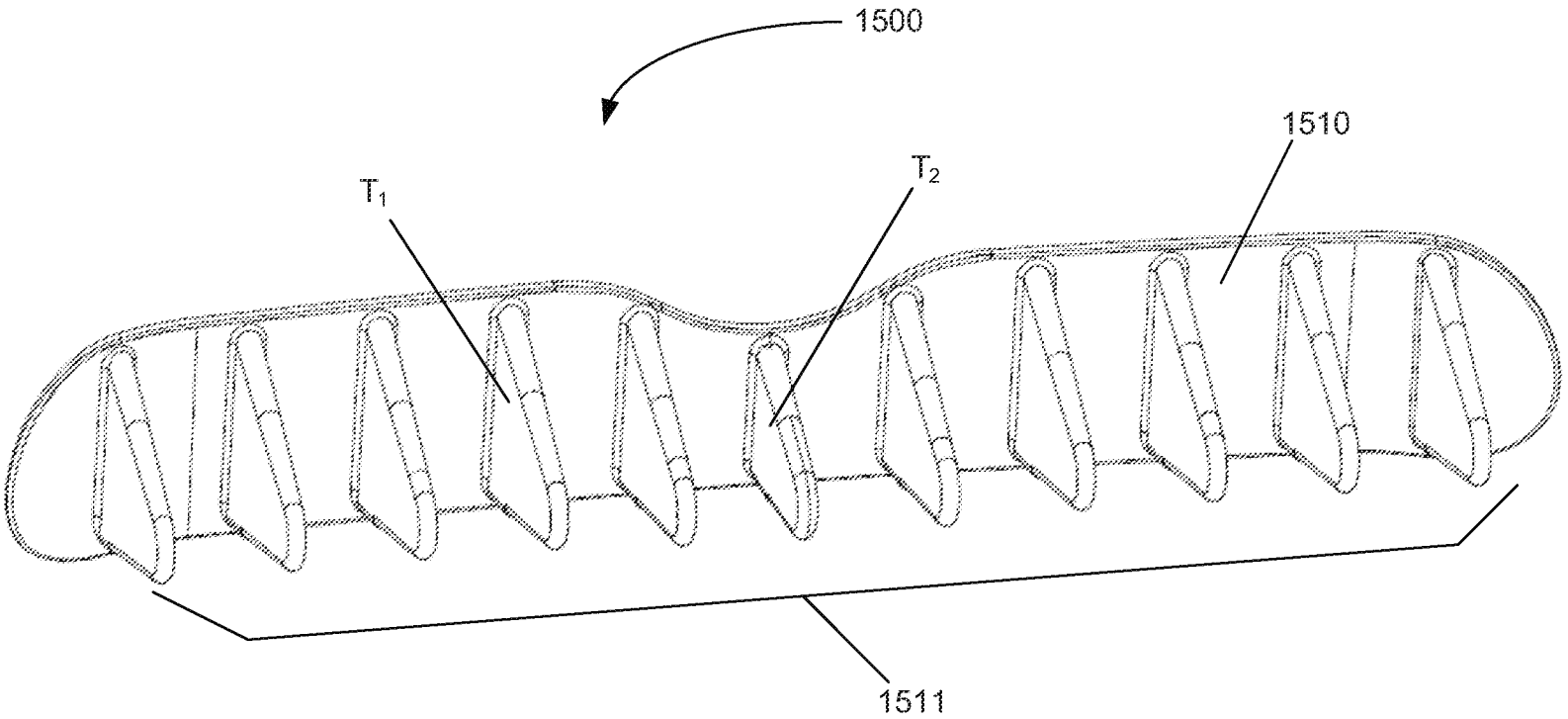
FIG. 6B is a front perspective view of the tooth assembly of FIG. 6A.
Figure 6C:
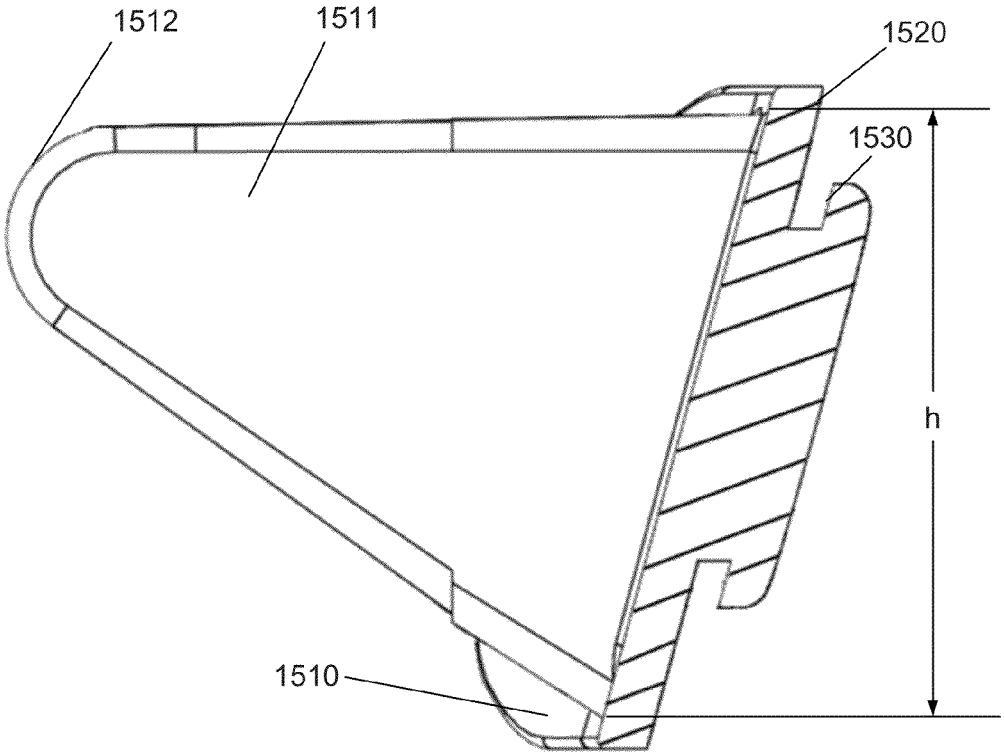
FIG. 6C is a cross-sectional view of the tooth assembly of FIG. 6A taken along the line 6C-6C in FIG. 6A.

Referring to FIGS. 6A-6C, the tooth assembly 1500 includes a first surface 1510, a second surface 1520, and a third surface 1530. The second surface 1520 (FIG. 6A) has a size $S_1$. A first protrusion 1531, a second protrusion 1532, and a third protrusion 1533 extend front the second surface 1520, each with a substantially mushroom-shaped cross-section. Similarly stated, the shape of the protrusions 1531, 1532, and 1533 are such that the base of the protrusions define a smaller cross-sectional area than the end of the protrusions. As shown, the first protrusion 1531 and the second protrusion 1532 are of a similar size $S_2$, while the third protrusion 1533 is of a smaller size $S_3$. The size and shape of the first protrusion 1531, the second protrusion 1532, and the third protrusion 1533 can be any suitable shape such that protrusions 1531, 1532, and 1533 secure the tooth assembly 1500 to the back wall 1220. More specifically, the size and shape of each of the protrusions 1531, 1532, and 1533, respectively, depends on the size and shape of the set of apertures 1223 in the back wall 1220 of the dustpan 1000.

The end portions of the mushroom-shaped protrusions 1531, 1532, and 1533, respectively, create the third surface 1530 (FIG. 6C). In this manner, the first protrusion 1531, the second protrusion 1532, and the third protrusion 1533 are inserted into the corresponding set of apertures 1223 in the back wall 1220 such that the protrusions 1531, 1532, 1533 engage and secure the tooth assembly 1500 to the back wall 1220. The tooth assembly 1500 can be unitarily formed of a flexible material, for example rubber, such that the end portions of the protrusions 1531, 1532, and 1533, respectively, deform to a second configuration as they are inserted into the corresponding aperture 1223. Once fully inserted the end portion of the protrusions 1531, 1532, and 1533 are substantially outside the corresponding set of apertures 1223 and return to the first configuration or undeformed shape. This arrangement results in an inner portion 1224 (FIG. 4) of the back wall 1220 being placed in contact with the second surface 1520 (FIG. 6A) and an outer portion 1225 (FIG. 3) of the back wall 1220 to be in contact with the third surface 1530 (FIG. 6A), thereby coupling the tooth assembly 1500 to the back wall 1220. Similarly stated, when the protrusions 1531, 1532, and 1533, respectively, are inserted into the set of apertures 1223, the second surface 1520 and the third surface 1530 contact the back wall 1220 on opposite sides. Thus, the tooth assembly 1500 is secured to the back wall 1220 by frictional engagement between the portion of the protrusions 1531, 1532, and 1533 disposed within the respective aperture 1223.

The plurality of protrusions 1511 extending inward from the first surface 1510 can have a similar size and shape. In some embodiments, the size and shape can vary for example, the protrusions 1511 can have a first size $T_1$ and a second size $T_2$, as shown in FIG. 6B. More specifically, the center protrusion 1511 of the tooth assembly 1500 has the size $T_2$ that is substantially smaller than the rest of the protrusions 1511 with the size $T_1$. This arrangement occurs due to a portion of the tooth assembly 1500 having a reduced height corresponding to the reduced height of the back wall 1220 where the grip portion 1411 couples to the back wall 1220. While the size of the protrusions 1511 shown vary due to the shape of the back wall 1220 and the grip portion 1411, the size of the protrusions 1511 could vary for any other suitable reason. For example, in some embodiments, the use of protrusions 1511 with different sizes can result in removing more debris from the broom as the bristles are swept across the protrusions 1511.

As shown, the cross-sectional shape of the protrusions 1511 is substantially triangular. The cross-sectional shape of the protrusions 1511 includes a substantially rounded tip 1512 at the distal end of the protrusion 1511. In some embodiments, the tip 1512 can be substantially flat or can include a second protrusion. For example, the tip 1512 of the protrusion 1511 can include a ball shaped protrusion configured to aid in the removal of debris from the bristles of the broom.

The protrusions 1511 of the tooth assembly 1500, while described as having a triangular cross-section, can have any suitable cross-section. For example, the protrusions 1511 may closely resemble the bristles of a broom extending from a first face of the tooth assembly 1500. In some embodiments, the protrusions can be arranged in a staggered pattern. For example, the tooth assembly can include a bottom row of protrusions and a top row of protrusions in a staggered pattern, e.g., the top row of protrusions are directly above the space created between adjacent protrusions of the bottom row.

Figure 7:
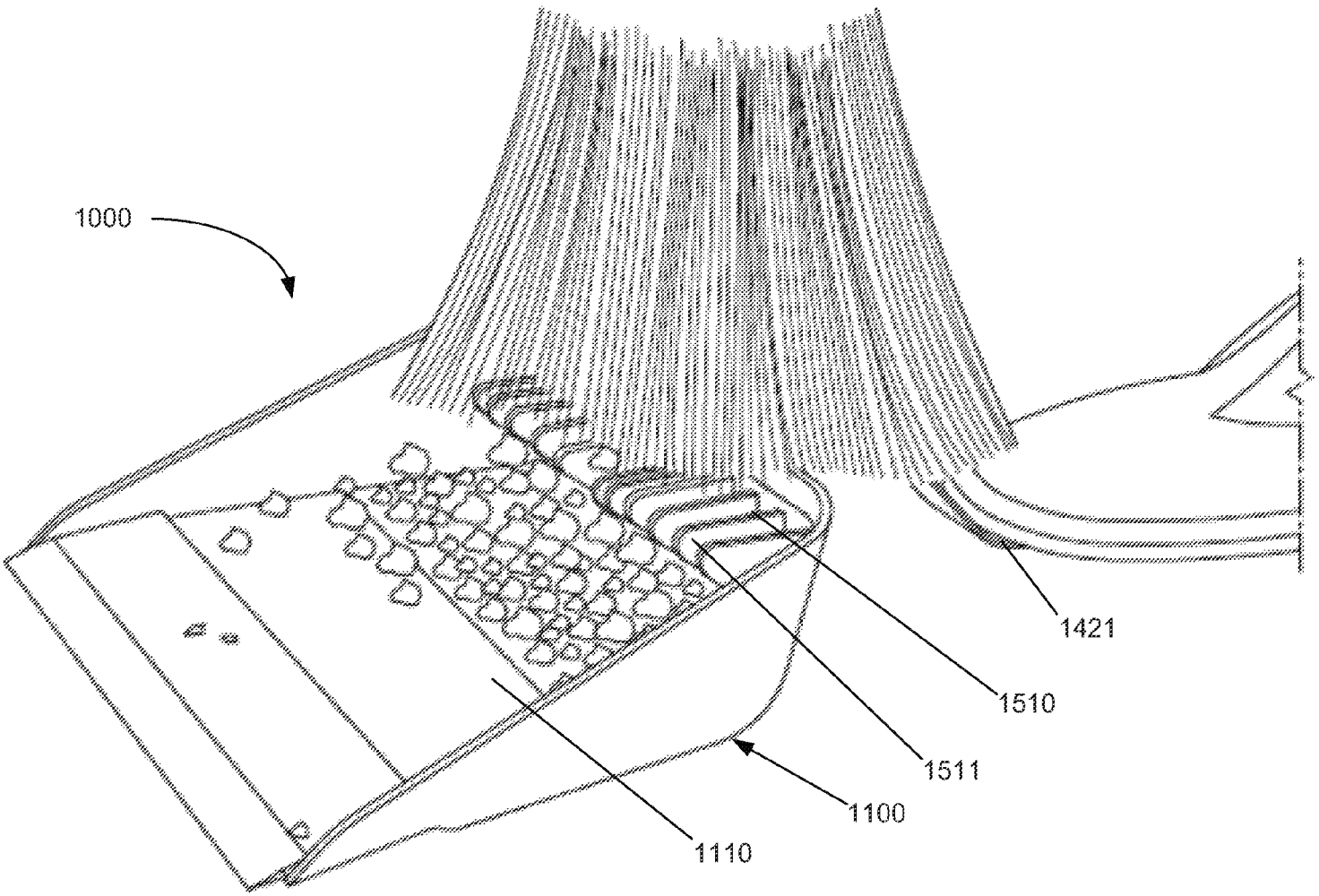
FIG. 7 is a schematic illustration of a dustpan in use according to an embodiment.

Referring now to FIG. 7, the protrusions 1511 are configured to separate the bristles of the broom such that the debris entrained in the bristles is removed from the broom and deposited into the dustpan 1000. The configuration of the protrusions 1511 andlor the tooth assembly 1500 is such that as debris is removed from the broom, and accumulates in the first portion 1110 of the base 1100 of the dustpan 1000. Furthermore, the user's foot is placed on the foot pedal 1421 and is used to anchor the proximal end of the dustpan 1000 to the surface being cleaned.

FIGS. 8-10B illustrate a dustpan 2000 according to another embodiment. The dustpan 2000 includes a base 2100, a set of walls 2200, a handle 2400, and a tooth assembly 2500 having a plurality of protrusions 2511. The base 2100 includes a first portion 2110 and a second portion 2120 and is confipred to be placed in contact with a surface to be cleaned, such that debris can be swept over a front lip 2121 and into the dustpan 2000. While shown in FIG. 8 as having a particular shape, the base 2100 and walls 2200 can be any given shape. For example, the form and function of the base 2100 and walls 2200 can be substantially similar to the form and function of the base 1100 and the walls 1200 of the dustpan 1000. Therefore, specific aspects of the base 2100 and the walls 2200 are not described in detail herein, and, as such, should be considered as being any suitable form, such as, for example, those discussed with respect to the dustpan 1000.

Figure 9:
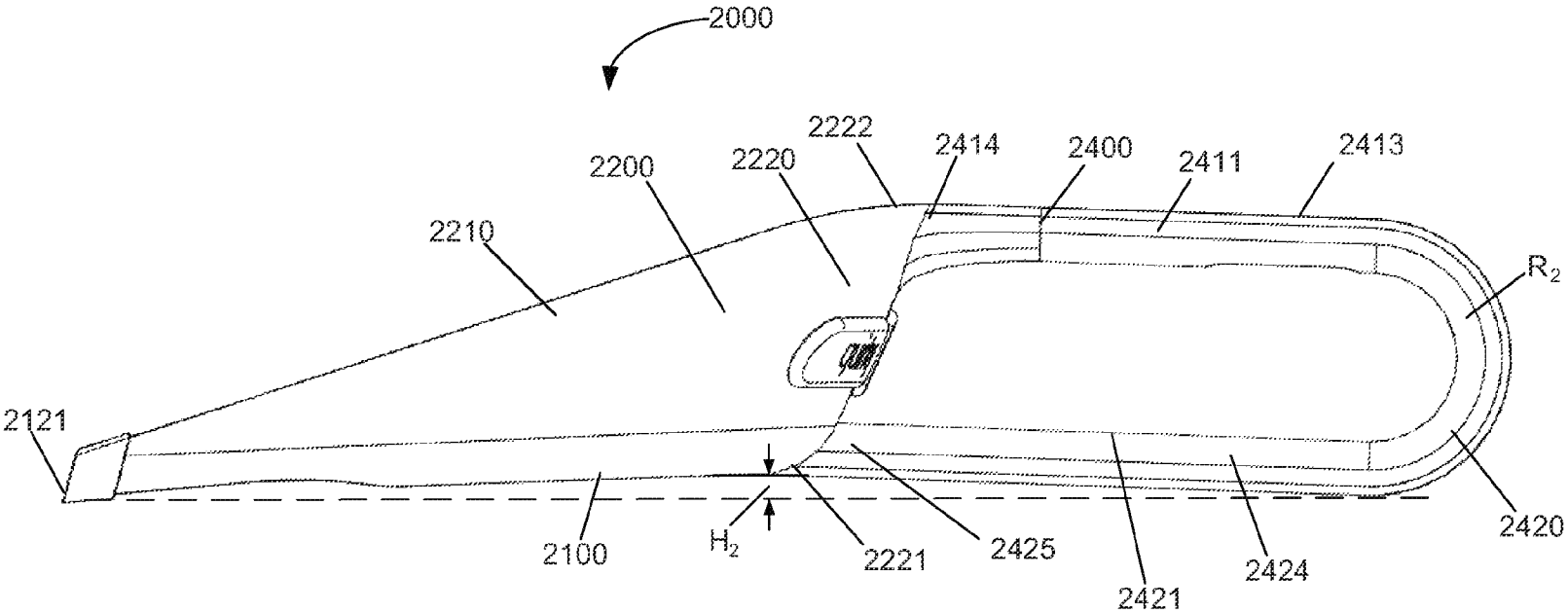
FIG. 9 is a side view of the dustpan of FIG. 8.

The handle 2400 includes a top arm 2413 with a first end 2414 and a bottom arm 2424 with a first end 2425 (FIG. 9). The first end 2414 of the top arm 2413 extends from a top edge 2222 of a back wall 2220 in a direction opposite a front lip 2121. Similarly, the first end 2425 of the bottom arm 2424 extends from a bottom portion 2221 of the back wall 2220 in a direction opposite the front lip 2121. The handle 2400 includes an end portion 2420 configured to couple the top arm 2413 and the bottom arm 2424. As shown, the top arm 2413 and the bottom arm 2424 extend away from the back wall 2220 in a substantially linear path toward the end portion 2420. The end portion 2420 can include a radius of curvature $R_2$. The radius of curvature $R_2$ can be any suitable radius such that an arcuate path exists between the top arm 2413 and the bottom arm 2424. In some embodiments, the radius of curvature $R_2$ can be uniform, i.e., a constant radius forming a smooth arc between the top arm 2413 and the bottom arm 2424. In some embodiments, the end portion 2420 can be substantially straight.

Figure 8:
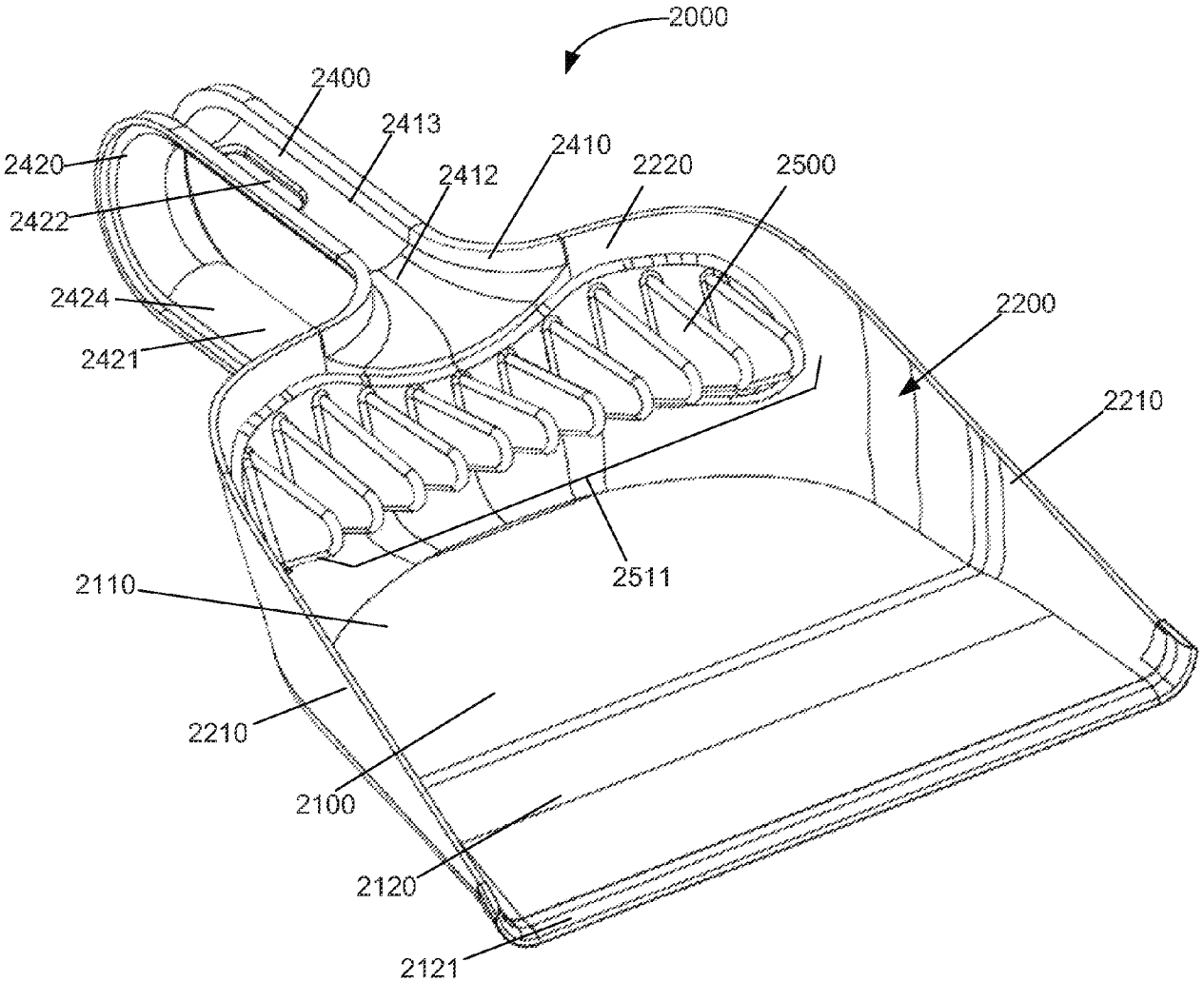
FIG. 8 is a perspective view of a dustpan according to an embodiment.

The handle 2400 can also include a grip portion 2411 disposed between the first end 2414 of the top arm 2413 and the end portion 2420. As shown in FIG. 8, the grip portion 2411 has an arcuate cross-section 2412. The arcuate cross-section 2412 of the grip portion 2411 provides an ergonomic configuration for the user to grip the handle 2400 of the dustpan 2000. The grip portion 2411 extends below the handle 2400 such that a curved surface of the arcuate cross-section 2412 matches the natural curve of the user's hand while gripping the handle 2400. The grip portion 2411 can include an aperture 2422 that can be used to hang the dustpan 200 while not in use. While shown as substantially smooth, the grip portion 2411 can be textured to create more friction with the user's hand. In some embodiments, the arcuate cross-section 2412 of the grip portion 2411 can include a set of indentations configured to match the placement of a user's individual fingers, whereas each indentation would create a channel for an individual finger. Additionally, the end portion 2420 and the bottom arm 2424 can include the arcuate cross-section 2412. Although described as being arcuate, the cross-section 2412 could be any suitable shape. For example, in some embodiments the cross-section can be substantially rectangular with or without rounded corners, elliptical, or round.

As shown in FIG. 9, the arrangement of the bottom arm 2424, and more specifically the proximal end of the bottom arm 2424 and the end portion 2420, creates an offset distance betAyeen the proximal end of the base 2100 and the surface to be cleaned. Similarly stated, the end portion 2420 of the handle 2400 extends below the surface of the proximal end of the base 2100 such that a height $H_2$ exists between the proximal end of the base 2100 and the surface to be cleaned. The bottom arm 2424 defines a foot pedal 2421 and can be configured to receive the user's foot, thus anchoring the dustpan 2000 to the surface to be cleaned. The size of the foot pedal 2421 is such that a portion of the user's foot can contact a portion of the first end 2425 of the bottom arm 2424. The handle 2400 is configured such that when the user's foot contacts the first end 2425 of the bottom arm 2424 the downward force applied by the user's foot is transferred through the handle 2400 towards the body of the dustpan 2000 (i.e., the base 2100 and walls 2200). In this manner, the bottom arm 2424 acts as a lever such that the downward force of the user's foot results in the first end 2425 of the bottom arm 242 applying a corresponding downward force to the body of the dustpan 2000. The resulting force at the first end 2425 of the bottom arm 2424 causes the base 2100 to move downward reducing the height $H_2$ that exists between the base 2100 and the surface to be cleaned until the proximal end of the base 2100 comes in contact with the surface to be cleaned.

Figure 10A:
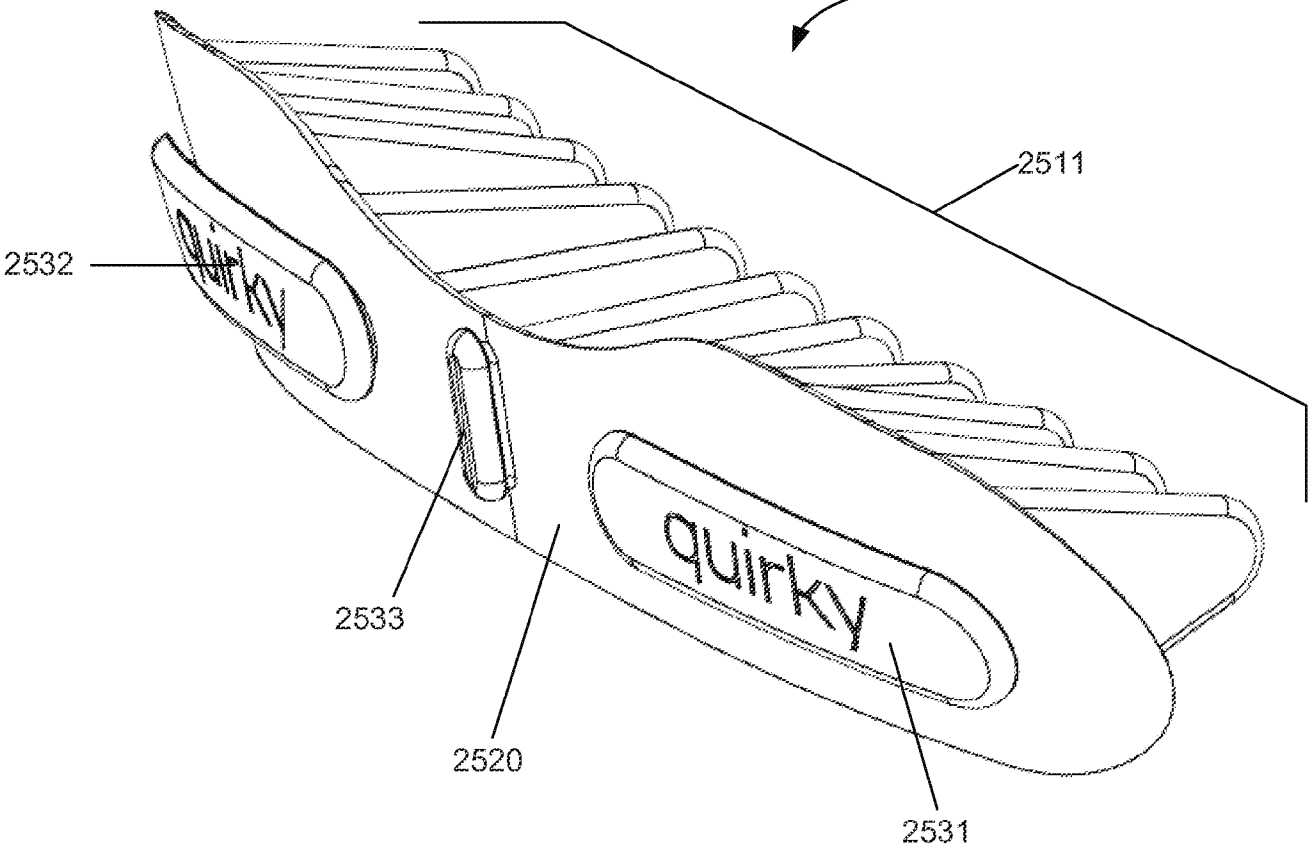
FIG. 10A is a rear perspective view of a tooth assembly according to an embodiment.
Figure 10B:
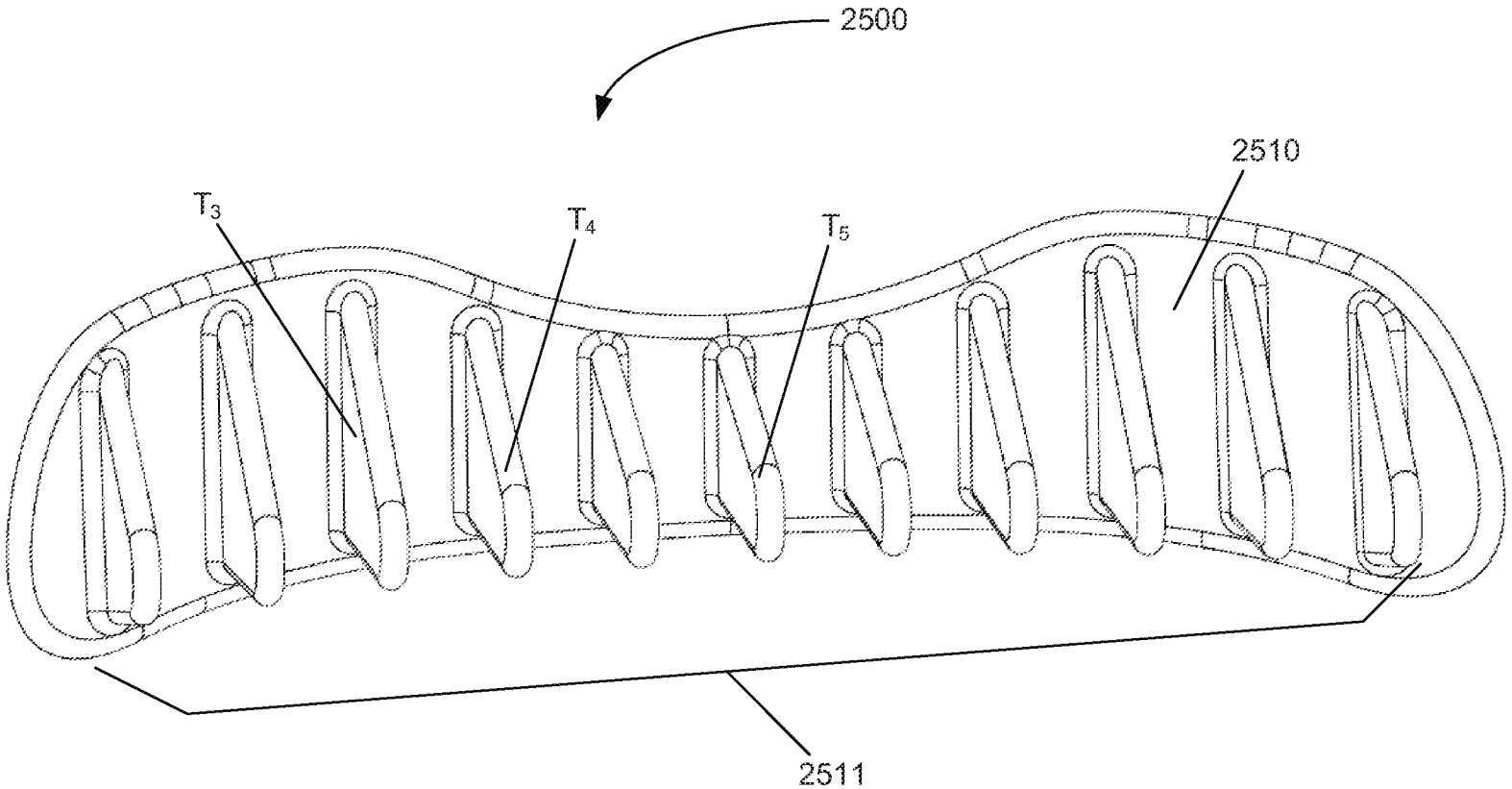
FIG. 10B is a front perspective view of the tooth assembly of FIG. 10A.

Referring to FIGS. 10A-10B, the tooth assembly 2500 includes a first surface 2510, and a second surface 2520. A first protrusion 2531, a second protrusion 2532, and a third protrusion 2533 extend from the second surface 2520 and are configured to couple the tooth assembly 2500 to the back wall 2220. While shown in FIG. 10A as having a particular size and shape, the protrusions 2531, 2532, and 2533 can be any given shape. For example, the form and function of the protrusions 2531, 2532, and 2533 can be substantially similar to the form and function of the 1531, 1532, and 1533 of the dustpan 1000. Therefore, specific aspects are not described in detail herein, and, as such, should be considered as being any suitable form, such as, for example, those discussed with respect to the dustpan 1000.

The plurality of protrusions 2511 can extend inward from the first surface 2510 of the tooth assembly 2500. In some embodiments, the size and shape can vary, for example, the protrusions 2511 can have a first size $T_3$, a second size $T_4$, and a third size $T_5$, as shown in FIG. 10B. More specifically, the three center protrusions of the tooth assembly 2500 have the size $T_5$ and the two protrusions on either side of the three center protrusions have a size $T_4$. The sizes $T_4$ and $T_5$ are smaller than the rest of the protrusions 2511 with the size $T_3$. This arrangement occurs due, in part, to a portion of the tooth assembly 2500 having a reduced height corresponding to the reduced height of the back wall 2220 where the grip portion 2411 couples to the back wall 2220. While the size of the protrusions 2511 shown vary due to the shape of the back wall 2220 and the grip portion 2411, the size of the protrusions 2511 could vary for any other suitable reason. For example, in some embodiments, the use of protrusions 2511 with different sizes can result in removing more debris from the broom as the bristles are swept across the protrusions 2511.

While shown in FIGS. 10A and 10B as having a given cross-section, the protrusions 2511 of the tooth assembly 2500 can have any suitable cross-section described herein. For example, the protrusions 2511 can have a cross-section substantially similar to the cross-section of the protrusions 1511 of the tooth assembly 1500, described in reference to FIGS. 6A-6C. In some embodiments, the protrusions can be arranged in a staggered pattern. For example, the tooth assembly can include a bottom row of protrusions and a top row of protrusions in a staggered pattern, e.g., the top row of protrusions are directly above the space created between adjacent protrusions of the bottom row.

The waste receptacle or dustpan described herein can be formed of any suitable material or using any suitable method. Furthermore, various components can be of similar or different materials. Similarly, various components of the dustpan can be unitarily formed or be comprised of multiple parts. For example, the body of the dustpan 1000 (i.e., the base 1100 and the set of walls 1200) can be formed of a hard plastic, while the skirt 1300, the tooth assembly 1500, and the insert 1423 can be formed of a flexible rubber.

In some embodiments, the plurality of protrusions can be unitarily formed of plastic with the body of the dustpan. An over-mold can be used to apply a layer of rubber material over the plastic base layer of the protrusions and/or the handle to modify the characteristics of such components. For example, a rubber over-mold can be used to increase the friction coefficient of the protrusions so more debris is removed. Furthermore, the rubber over-mold can be applied to the handle to increase comfort when a user grips the handle. In other embodiments, no over-mold is applied, thus the protrusions are rigid.

While various embodiments have been described above, it should be understood that they have been presented by way of example only, and not limitation. Where schematics and/or embodiments described above indicate certain components arranged in certain orientations and/or positions, the arrangement of components may be modified. Similarly, where methods and/or events described above indicate certain events and/or procedures occurring in certain order, the ordering of certain events and/or procedures may be modified. While the embodiments have been particularly shown and described, it will be understood that various changes in form and details may be made.

What is claimed is:

1. An apparatus comprising:
- a dustpan configured to receive and contain debris, the dustpan including:
  - a base configured to be placed in contact with a surface to be cleaned, the base having a front lip over which debris can be swept into the dustpan;
  - a wall extending upwardly from at least a portion of the base other than the front lip and having a top edge, the wall configured to contain debris in the dustpan;
- a handle having a first end and a second end, the first end coupled to the top edge of the wall of the dustpan opposite the front lip, the handle extending away from the wall and downwardly from the top edge so that the second end is disposed approximately even with the base so that when the dustpan is placed on a surface to be cleaned the second end of the handle can contact the surface; and
- a plurality of protrusions extending from the wall toward the front lip of the dustpan, each of the protrusions having a first surface and a second surface opposite the first surface of the protrusion, the first and second surfaces of the protrusion oriented approximately perpendicular to the base of the dustpan and having spaces adjacent to each of the first and second surfaces of the protrusion, the plurality of protrusions configured to remove debris from bristles of a broom when the broom is swept through the plurality of protrusions.

2. The apparatus of claim 1, wherein the handle has an arcuate shape between the first end and the second end.

3. The apparatus of claim 1, wherein the handle further includes a foot pedal extending from the second end, the foot pedal configured to be engagable by the foot of a user to anchor the second end of the handle to a surface to be cleaned.

4. The apparatus of claim 1, wherein the handle has a substantially arcuate cross-section.

5. The apparatus of claim 1, wherein each of the plurality of protrusions are approximately equally spaced from each other.

6. The apparatus of claim 1, wherein at least one of the plurality of protrusions has a substantially triangular cross-section.

7. The apparatus of claim 1, wherein the plurality of protrusions are flexible.

8. The apparatus of claim 1, wherein the plurality of protrusions are rubber.

9. The apparatus of claim 1, wherein at least one protrusion of the plurality of protrusions is a different size than a second protrusion of the plurality of protrusions.

10. An apparatus comprising:
- a dustpan configured to receive and contain debris, the dustpan including:
  - a base configured to be placed in contact with a surface to be cleaned, the base having a front lip over which debris can be swept into the dustpan;
  - a wall extending upwardly from at least a portion of the base other than the front lip, the wall configured to contain debris in the dustpan;
- a handle having a first end and a second end, the first end coupled to the dustpan, the handle extending away from the dustpan so that the second end is disposed approximately even with the base so that when the dustpan is placed on a surface to be cleaned the second end of the handle can contact the surface; and a plurality of approximately planar protrusions extending from the wall toward the front lip of the dustpan, each of the approximately planar protrusions having a substantially triangular cross-section and in a plane approximately perpendicular to the base of the dustpan, the plurality of protrusions defining spaces therebetween and configured to remove debris from bristles of a broom when the broom is swept through the plurality of protrusions.

11. The apparatus of claim 10, wherein the plurality of protrusions are flexible.

12. The apparatus of claim 10, wherein the plurality of protrusions are rigid.

13. The apparatus of claim 10, wherein the plurality of protrusions are rubber.

14. The apparatus of claim 10, wherein each of the plurality of protrusions are approximately equally spaced from each other.

15. The apparatus of claim 10, wherein at least one protrusion of the plurality of protrusions is a different size than a second protrusion of the plurality of protrusions.

16. An apparatus comprising:

a dustpan configured to receive and contain debris, the dustpan including:

a base configured to be placed in contact with a surface to be cleaned, the base having a front lip over which debris can be swept into the dustpan;

a wall extending upwardly from at least a portion of the base other than the front lip, the wall configured to contain debris in the dustpan;

a handle coupled to the dustpan and configured to allow a user to place the base in contact with the surface to be cleaned; and a tooth assembly having a first end, a second end, a first surface, and a second surface, the tooth assembly secured to the wall by the second surface, the first surface including a plurality of protrusions extending from the first surface toward the front lip of the dustpan and spaced along the length of the tooth assembly between the first end and the second end, each of the protrusions being approximately planar and elongated in a direction approximately perpendicular to the base of the dustpan, the plurality of protrusions defining spaces therebetween and configured to remove debris from bristles of a broom when the broom is swept through the plurality of protrusions.

17. The apparatus of claim 16, wherein the tooth assembly is unitarily formed.

18. The apparatus of claim 16, wherein at least one of the plurality of protrusions has a substantially triangular cross-section.

19. The apparatus of claim 16, wherein the plurality of protrusions are flexible.

20. The apparatus of claim 16, wherein the handle has a first end and a second end, the first end coupled to the dustpan, the handle extending away from the dustpan so that the second end is disposed approximately even with the base.

21. The apparatus of claim 20, wherein the wall has a top edge and the first end of the handle is coupled to the top edge of the wall of the dustpan opposite the front lip.

22. The apparatus of claim 16, wherein the handle is substantially U-shaped and includes a connector and two ends, the two ends coupled to the dustpan opposite the front lip.

23. A dustpan configured to receive and contain swept debris, the dustpan comprising:

a base configured to be placed in contact with a surface to be cleaned, the base having a front edge over which debris can be swept into the dustpan;

a wall extending upwardly from at least a portion of the base other than the front edge, the wall at least partially configured to contain debris in the dustpan; and a tooth assembly having a first end, a second end, a first surface, and a second surface, the tooth assembly secured to the wall by the second surface, the first surface including a plurality of approximately planar protrusions extending from the first surface toward the front edge of the dustpan and discretely spaced along the length of the tooth assembly between the first end and the second end, each of the approximately planar protrusions elongated in a direction approximately perpendicular to the base of the dustpan, the plurality of approximately planar protrusions configured to remove debris from bristles of a broom when the broom is swept through the plurality of approximately planar protrusions.

24. The apparatus of claim 23, wherein the tooth assembly is removably coupleable to the wall of the dustpan.

25. The apparatus of claim 23, wherein the plurality of protrusions are rubber.

26. The apparatus of claim 23, wherein the plurality of protrusions are plastic.

27. The apparatus of claim 23, wherein each of the plurality of protrusions are approximately equally spaced from each other.

28. The apparatus of claim 16, wherein each of the protrusions has a thickness, the thickness being substantially less than a distance between adjacent protrusions.

29. The apparatus of claim 28, wherein the distance is greater than twice the thickness.

30. The apparatus of claim 16, wherein each of the protrusions has a thickness and a height at the first surface, the height being greater than the thickness.

31. The apparatus of claim 16, wherein each of the protrusions has a thickness and a height at the first surface, the height being greater than the thickness, and the thickness being substantially less than a distance between adjacent protrusions.

32. The apparatus of claim 23, wherein each of the plurality of protrusions has a thickness, the thickness being substantially less than a distance between adjacent protrusions.

33. The apparatus of claim 32, wherein the distance is greater than twice the thickness.

34. The apparatus of claim 32, wherein each of the plurality of protrusions are approximately equally spaced from each other.

35. The apparatus of claim 23, wherein each of the protrusions has a thickness and a height at the first surface, the height being greater than the thickness.

36. The apparatus of claim 23, wherein each of the protrusions has a thickness and a height at the first surface, the height being greater than the thickness, and the thickness being substantially less than a distance between adjacent protrusions.

* * * * *